US010801166B2

(12) United States Patent
Trilling et al.

(10) Patent No.: US 10,801,166 B2
(45) Date of Patent: Oct. 13, 2020

(54) DYNAMIC PAVER DEVICE WITH VIBRATION FEEDBACK

(71) Applicant: Sidewalk Labs LLC, New York, NY (US)

(72) Inventors: Samara Trilling, New York, NY (US); Thomas Joseph Kennedy, Brooklyn, NY (US)

(73) Assignee: Sidewalk Labs LLC, New York, NY (US)

( * ) Notice: Subject to any disclaimer, the term of this patent is extended or adjusted under 35 U.S.C. 154(b) by 0 days.

(21) Appl. No.: 16/549,753

(22) Filed: Aug. 23, 2019

(65) Prior Publication Data

US 2020/0063381 A1 Feb. 27, 2020

Related U.S. Application Data

(60) Provisional application No. 62/722,140, filed on Aug. 23, 2018.

(51) Int. Cl.
*E01C 15/00* (2006.01)
*E01C 5/06* (2006.01)
(Continued)

(52) U.S. Cl.
CPC ..... *E01C 15/00* (2013.01); *E01C 5/065* (2013.01); *E01C 5/18* (2013.01); *E01C 11/00* (2013.01); *E01C 17/00* (2013.01)

(58) Field of Classification Search
CPC . E01C 5/065; E01C 5/18; E01C 11/00; E01C 15/00; E01C 17/00
(Continued)

(56) References Cited

U.S. PATENT DOCUMENTS 9,311,831 B2 * 4/2016 Henshue ..... G09F 19/228
1,040,312 A1 9/2019 Suarez
(Continued)

FOREIGN PATENT DOCUMENTS

CN 207537849 6/2018
KR 101702343 2/2017

OTHER PUBLICATIONS

International Search Report and Written Opinion dated Nov. 18, 2019 in International Patent Application No. PCT/US2019/047919.

*Primary Examiner* — Raymond W Addie
(74) *Attorney, Agent, or Firm* — Byrne Poh LLP

(57) ABSTRACT

A dynamic paver device with vibration feedback is provided. In some embodiments, a paver device comprises: a paver having a top surface and a bottom surface; a paver frame that creates an interior cavity upon being connected with the paver; at least one pressure sensor connected to the paver, wherein the at least one pressure sensor detects a change in an amount of pressure applied to the top surface of the paver; a vibration system connected to the bottom surface of the paver, wherein the vibration system is configured to provide a vibrational force to the bottom surface of the paver; and a controller connected to the at least one pressure sensor and the vibration system, wherein the controller is configured to: receive, from the at least one pressure sensor, a presence indication of an object on the top surface of the paver based on the detected change in the amount of pressure being applied to the top surface of the paver at a first time; and, in response to receiving the presence indication from the at least one pressure sensor, transmit a first signal to the vibration system that causes the vibration system to provide the vibrational force to the bottom surface of the paver.

20 Claims, 8 Drawing Sheets

(51) Int. Cl.
*E01C 11/00* (2006.01)
*E01C 5/18* (2006.01)
*E01C 17/00* (2006.01)

(58) Field of Classification Search
USPC ..... 404/34–36, 72; 341/4.1
See application file for complete search history.

(56) References Cited

U.S. PATENT DOCUMENTS

| | | | | |
|---|---|---|---|---|
| 2008/0224894 | A1* | 9/2008 | Uhm ..... | H04B 5/02<br>340/944 |
| 2010/0308982 | A1 | 12/2010 | Cooperstock et al. | |
| 2017/0252256 | A1 | 9/2017 | Henshue et al. | |

* cited by examiner

DYNAMIC PAVER DEVICE WITH VIBRATION FEEDBACK

CROSS-REFERENCE TO RELATED APPLICATION

This application claims the benefit of U.S. Provisional Patent Application No. 62/722,140, filed Aug. 23, 2018, which is hereby incorporated by reference herein in its entirety.

TECHNICAL FIELD

The disclosed subject matter relates to a dynamic paver device with vibration feedback.

BACKGROUND

One of the challenges for blind and/or visually impaired users is navigating an urban area. This is particularly challenging when navigating an urban area in which the blind and/or visually impaired person is unfamiliar. Moreover, there are a number of difficult and potentially dangerous areas for such a person to navigate, such as crossing a road.

Currently, blind and/or visually impaired users are assisted with crossing a road by audio-enabled guidance that is triggered by pressing a button on a pole associated with the intersection. For example, at a crosswalk, a button may be present on a pole that allows a user to indicate an intent to cross the intersection (e.g., by pressing the button). Pressing the button may trigger an audible indication at a particular time to alert the user that the lights are such that crossing the street is appropriate at that time. This form of assistance, however, may be difficult to use when blind and/or visually impaired users are unable to find the button or are unable to determine how much time is remaining to cross the intersection.

This can present a significant challenge for blind and/or visually impaired users, particularly in major metropolitan areas, where there are hundreds upon thousands of crosswalks and a user may navigate multiple crosswalks in a single trip through such a metropolitan area.

Accordingly, there is a need in the art for approaches that overcome these and other deficiencies of the prior art.

SUMMARY

In accordance with various embodiments of the disclosed subject matter, a dynamic paver device with vibration feedback is provided.

In accordance with some embodiments of the disclosed subject matter, a paver device is provided, comprising: a paver having a top surface and a bottom surface; a paver frame that creates an interior cavity upon being connected with the paver; at least one pressure sensor connected to the paver, wherein the at least one pressure sensor detects a change in an amount of pressure applied to the top surface of the paver; a vibration system connected to the bottom surface of the paver, wherein the vibration system is configured to provide a vibrational force to the bottom surface of the paver; and a controller connected to the at least one pressure sensor and the vibration system, wherein the controller is configured to: receive, from the at least one pressure sensor, a presence indication of an object on the top surface of the paver based on the detected change in the amount of pressure being applied to the top surface of the paver at a first time; and, in response to receiving the presence indication from the at least one pressure sensor, transmit a first signal to the vibration system that causes the vibration system to provide the vibrational force to the bottom surface of the paver.

In some embodiments, the paver is a precast concrete slab formed in a hexagonal shape.

In some embodiments, the paver is a rubber paver formed in a hexagonal shape.

In some embodiments, the paver is a porous paver formed in a hexagonal shape.

In some embodiments, the paver and the paver frame each have a hexagonal shape and form a hexagonal prism having the interior cavity when the paver and the paver frame are connected.

In some embodiments, the paver is flexibly mounted to the paver frame, wherein the vibration system is configured to provide the vibrational force to one or more portions of the paver frame.

In some embodiments, the paver is flexibly mounted to the paver frame using one or more springs, wherein the vibration system is configured to provide the vibrational force to the one or more springs.

In some embodiments, the paver is constructed from a first material and the paver frame is constructed from a second material, wherein the first material is different than the second material. In some embodiments, the paver and the paver frame are constructed from the same material.

In some embodiments, the at least one pressure sensor is positioned within the interior cavity. In some embodiments, the at least one pressure sensor is connected to the bottom surface of the paver.

In some embodiments, the paver device further comprises an optical sensor that detects presence of an object on the top surface of the paver. In some embodiments, the optical sensor receives image data relating to one or more objects on the top surface of the paver, wherein the controller is configured to transmit the first signal to the vibration system that causes the vibration system to provide the vibrational force to the bottom surface of the paver based on the image data relating to the one or more objects on the top surface of the paver.

In some embodiments, the presence indication is received from the at least one pressure sensor in response to determining that the change in the amount of pressure is greater than a threshold amount.

In some embodiments, the vibration system includes an electrodynamic coil that generates the vibrational force to the bottom surface of the paver, wherein the electrodynamic coil is connected to a power source.

In some embodiments, the vibration system includes a spring-loaded coil that is connected to a mass, wherein the mass contacts the bottom surface of the paver via the spring-loaded coil.

In some embodiments, the controller is further configured to transmit a second signal to the vibration system that causes the vibration system to inhibit the vibrational force from continuing to be applied to the bottom surface of the paver based on an updated change in the amount of pressure being applied to the top surface of the paver at a second time. In some embodiments, the updated change in the amount of pressure indicates that the object is stationary on the top surface of the paver. In some embodiments, the updated change in the amount of pressure indicates that the object is continuing to move, wherein a second signal is transmitted to the vibration system that causes the vibration system to provide a greater vibrational force to the bottom surface of the paver.

In some embodiments, the controller is further configured to: determine that a particular amount of time has elapsed; and, in response to the determining that the particular amount of time has elapsed, transmit a second signal to the vibration system that causes the vibration system to inhibit the vibrational force from continuing to be applied to the bottom surface of the paver.

In some embodiments, the controller is further configured to receive an instruction to provide the vibrational force to the bottom surface of the paver.

In some embodiments, the controller is connected to an additional paver that is adjacent to the paver, wherein the controller is further configured to transmit instructions to provide the vibrational force to the paver and the additional paver.

In some embodiments, the controller is connected to a power source.

BRIEF DESCRIPTION OF THE DRAWINGS

Various objects, features, and advantages of the disclosed subject matter can be more fully appreciated with reference to the following detailed description of the disclosed subject matter when considered in connection with the following drawings, in which like reference numerals identify like elements.

DETAILED DESCRIPTION

In accordance with various embodiments, a dynamic paver device with vibration feedback is provided.

Figure 1:
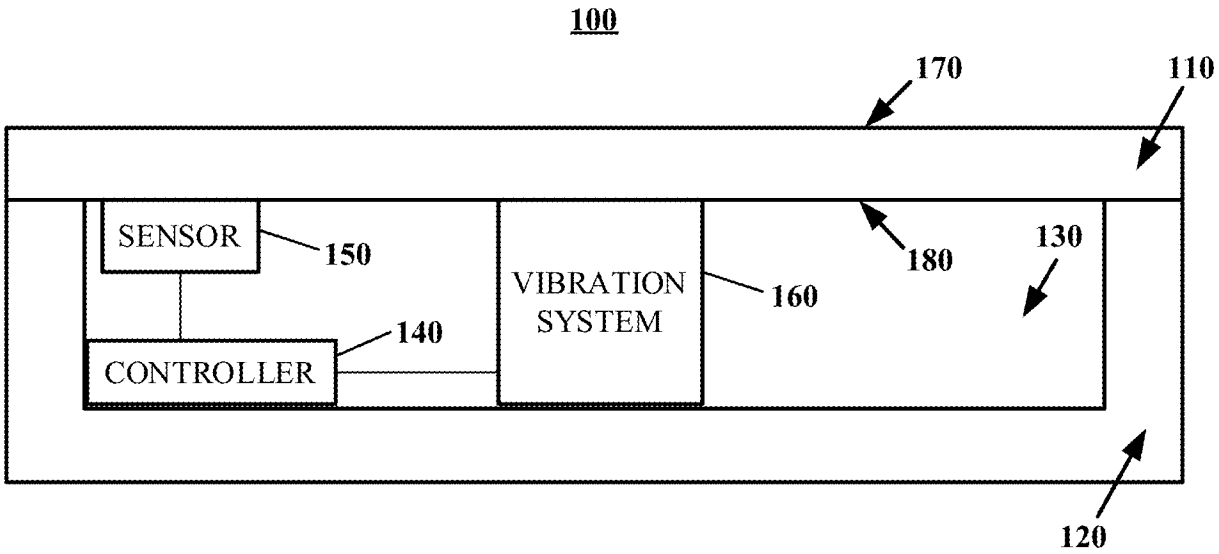
FIG. 1 shows an illustrative example of a cross-sectional view of a dynamic paver device in accordance with some embodiments of the disclosed subject matter.

Generally speaking, as shown in FIG. 1, a dynamic paver device 100 can include a paver 110 and a paver frame 120 that are connected to form a paver structure having an interior cavity 130, where the interior cavity 130 includes a processing device 140 that is connected to one or more sensors 150 and a vibration system 160. In response to sensor data from the one or more sensors 150, the processing device 140 can transmit a signal that causes the vibration system 160 to generate a vibrational force to the paver 110 and/or the paver frame 120, thereby providing a vibrational feedback to the person or object positioned on or nearby the surface of the paver 110. Additionally or alternatively, the processing device 140 can receive an instruction to generate a vibrational feedback (e.g., from a traffic management system, from a building management system, or any other suitable source) and, in response, can transmit a signal that causes the vibration system, 160 to generate a vibrational force to the paver 110 and/or the paver frame 120, thereby providing a vibrational feedback to a person or object positioned on or nearby the surface of the paver 110.

Figure 2:
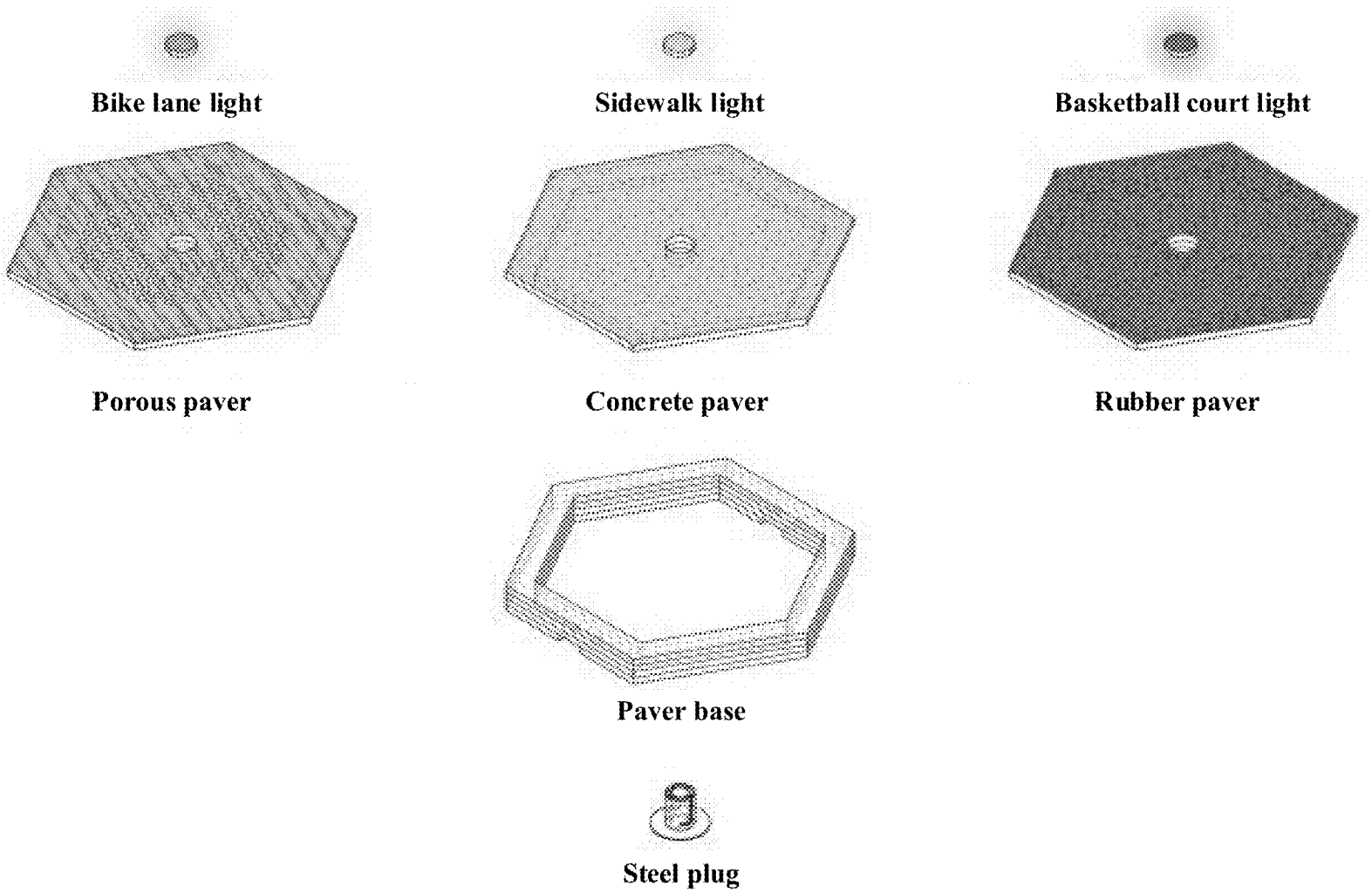
FIG. 2 shows an illustrative example of different types of pavers that can be used with a paver frame to form the paver structure of the dynamic paver device in accordance with some embodiments of the disclosed subject matter.
Figure 3:
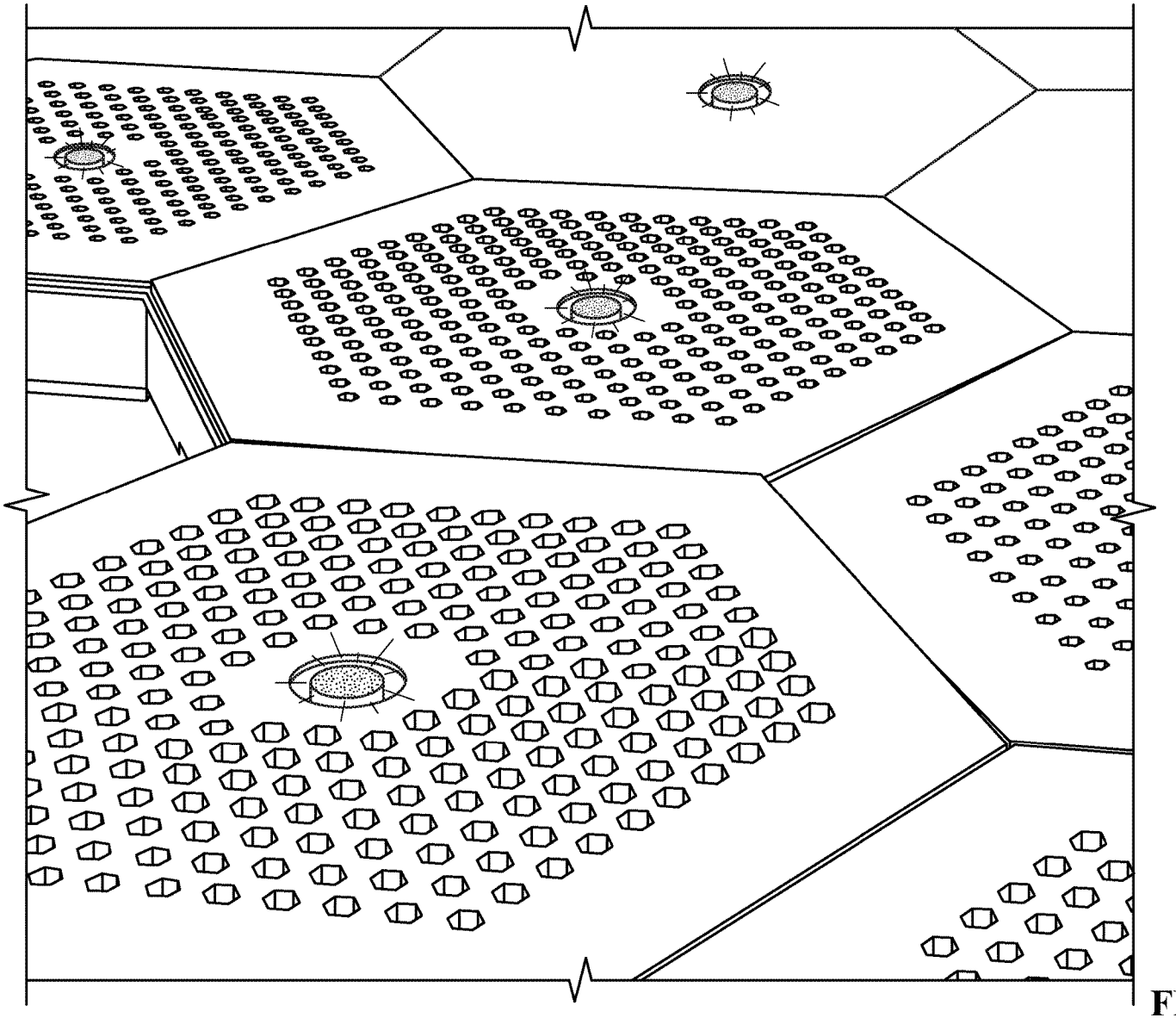
FIG. 3 shows an illustrative example of a porous paver that can be used to form the dynamic paver device in accordance with some embodiments of the disclosed subject matter.

It should be noted that any suitable type of paver 110 can be used in the dynamic paver device. For example, as shown in FIG. 2, the paver 110 can be a precast concrete slab that is formed in a hexagonal shape. In another example, the paver 110 can be a rubber paver formed of any suitable polymeric material. In yet another example, the paver 110 can have a porous structure in which openings have been formed that extend between a top surface 170 and a bottom surface 180 of the paver 110. An illustrative example of a porous paver is shown in FIG. 3.

Figure 4:
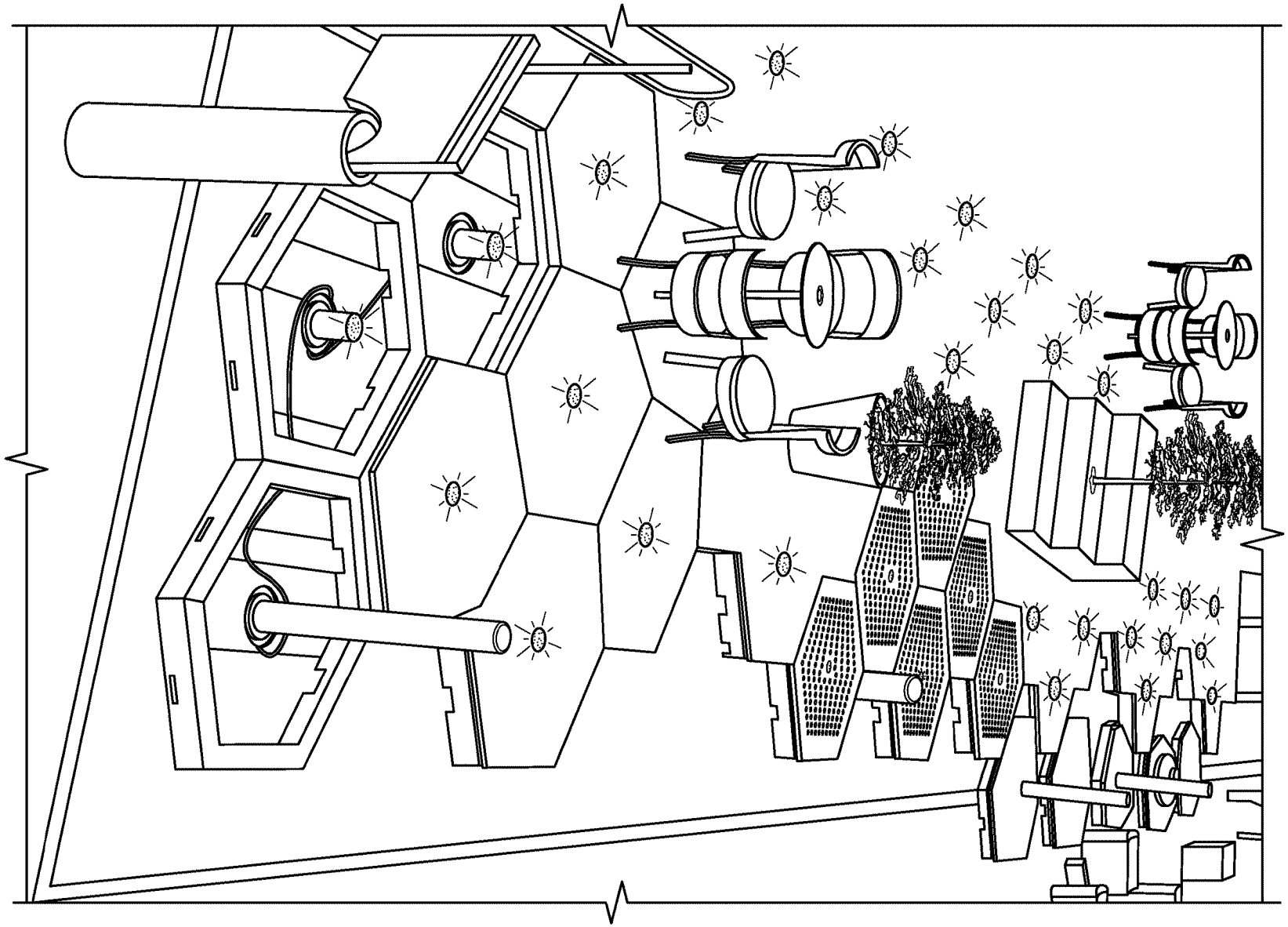
FIG. 4 shows an illustrative example of a paver structure having an interior cavity in accordance with some embodiments of the disclosed subject matter.

It should also be noted that the paver and the paver frame each have a hexagonal shape and, when connected, form a hexagonal prism having the interior cavity 130. An illustrative example of the interior cavity 130 of a paver structure among paver structures having differing pavers is shown in FIG. 4. As shown, components, such as power components, vibration systems, sensors, imaging devices, lighting devices, etc., can be positioned in the interior cavity 130.

Alternatively, in some embodiments, the paver and the paver frame can be any suitable shape. For example, while a roadway or pathway can be constructed by connecting precast concrete pavers that are hexagonal in shape, one or more dynamic paver devices that are rectangular in shape can be formed and placed on the border of the roadway or pathway (e.g., on the border of an intersection). In continuing this example, these rectangular dynamic paver devices can be positioned at particular locations along a pathway (e.g., a sidewalk) prior to entering a roadway.

Referring back to FIG. 1, the dynamic paver device can include one or more sensors or imaging devices 150. It should be noted that presence data from the sensors or imaging devices 150 (e.g., an indication that an object is present on the surface of a paver) can be stored in a memory device and/or transmitted to a controller or other suitable processing device.

For example, in some embodiments, the sensor 150 can be a pressure sensor or an occupancy sensor that is connected to a portion of the bottom surface 180 of the paver 110 of the dynamic paver device. Such a pressure sensor can detect a change in an amount of pressure being applied to a surface of the paver 110. In response to detecting a change in an amount of pressure being applied to the top surface 170 of the paver 110 that is greater than a threshold amount of pressure (e.g., a minimum amount of pressure applied by a person walking or standing on the top surface of the paver, an amount of pressure applied by a person using a mobility device, such as a wheelchair, etc.), the sensor 150 can transmit a presence signal to the processing device 140.

It should be noted that one or more pressure sensors 150 can be positioned along the bottom surface 180 of the paver 110 and within the interior cavity 130 of the dynamic paver device. Additionally or alternatively, the one or more pressure sensors 150 can be positioned in any suitable location of the dynamic paver device. For example, a pressure sensor 150 can be implemented by forming a piezo-resistive or other suitable pressure sensitive material on a surface of the paver 110, where compression of the pressure sensitive material can trigger the transmission of a presence indication to the processing device 140.

In another example, in some embodiments, the sensor 150 can be an optical sensor that is positioned to receive image data of objects on or near the top surface 170 of the paver 110 of the dynamic paver device. Such an optical sensor can detect that an object (e.g., a person, a mobility device, etc.) is present or has entered a region associated with the paver of the dynamic paver device. In response to detecting the presence of an object (e.g., the beginning of occupancy of the paver, such as a person walking onto the top surface of the paver), the optical sensor 150 can transmit a presence signal to the processing device 140. In some embodiments, the optical sensor 150 can also transmit the image data to the processing device 140, where the processing device 140 can analyze the image data to determine whether a particular object (e.g., a person, a mobility device, etc.) has been detected in connection with the paver 110 of the dynamic paver device. For example, in response to comparing the image data against a database of known images (e.g., an image of a mobility device), processing device 140 can determine that a particular object has been detected in connection with the paver 110 of the dynamic paver device.

In yet another example, in some embodiments, the sensor 150 can be a radar sensor that is configured to detect presence and/or motion information of users and/or objects one or near the top surface 170 of the paver 110 of the dynamic paver device. Such a radar sensor can detect that an object (e.g., a person, a mobility device, etc.) is present or is about to be standing on the top surface 170 of the paver 110 of the dynamic paver device. In response to detecting the presence of an object (e.g., the beginning of occupancy of the paver, such as a person walking onto the top surface of the paver), the radar sensor 150 can transmit the sensor data to the processing device 140. In continuing this example, the radar sensor 150 can continue to detect motion information associated with the object present on the top surface 170 of the paver 110 of the dynamic paver device. In a more particular example, the radar sensor 150 can transmit motion information to the processing device 140—e.g., an indication that the object is standing still, an indication that the object continues to move across the paver 110, an indication that the object is moving off the paver, etc. It should be noted that different vibrational forces can be applied to the surface of the paver based on the motion information (e.g., an initial vibrational force and an increasing vibrational force in response to determining that the object has not moved off the paver).

In a further example, sensor data can be received from an external source. For example, a processing device (e.g., a controller) within the dynamic paver device can be connected to a communication interface that is configured to receive sensor data or presence information from an external source (e.g., a traffic management system, a building management system, etc.). In continuing this example, a camera device that is connected to a building management system can transmit an indication that a person or a particular object is positioned on the dynamic paver device and the building management can transmit the presence indication to the processing device, which, in turn, can activate the dynamic paver device.

It should be noted that one or more optical sensors 150 can be positioned at any suitable location. For example, as shown in FIG. 2, various types of pavers can be used to create a dynamic paver device—e.g., a porous paver, a concrete paver, and a rubber paver. In continuing this example, when the paver is a porous paver having multiple openings to the top surface of the paver, one or more optical sensors 150 can be positioned within the openings of the porous paver. These optical sensors 150 can provide image data indicating when an object is positioned on the top surface 170 of the paver 110. In another example, the paver 110 can be modified to incorporate the optical sensor 150 such that a particular region of the surface of the paver 110 is viewable by the optical sensor 150.

In some embodiments, the dynamic paver device can include multiple sensors that each have particular detection criterion. For example, the dynamic paver device can include a pressure sensor that detects a change in an amount of pressure being applied to a surface of the paver and an optical sensor that detects whether an object (e.g., a person, a mobility device, etc.) is present or has entered a region associated with the paver of the dynamic paver device. In continuing this example, the dynamic paver device can transmit a presence signal or any other suitable detection signal to the processing device in response to determining that the pressure sensor has detected a change in pressure greater than a particular threshold value and in response to determining that the optical sensor has detected the presence of an object within a region corresponding to the paver. In another example, the dynamic paver device can transmit a presence signal or any other suitable detection signal to the processing device in response to any presence detection from one of the multiple sensors.

Based on the sensor data from the one or more sensors 150, the processing device 140 can, in turn, transmit a signal to the vibration system 160 that generates a vibrational force to the paver and/or the paver frame, thereby providing a vibrational feedback to the person or object positioned on or nearby the surface of the paver 110 of the dynamic paver device. Additionally or alternatively, the processing device can transmit a signal to the vibration system 160 that generates a vibrational force to the paver and/or the paver frame, thereby providing a vibrational feedback to the person or object positioned on or nearby the surface of the paver 110 of the dynamic paver device, in response to receiving an instruction from an external system (e.g., an external sensor network, a traffic management system, a building management system, etc.).

In some embodiments, the vibration system 160 can include an electrodynamic coil that generates the vibrational force to the bottom surface of the paver. For example, an electromagnetic coil can be wrapped around a magnetic array, where a shaft passes through the magnetic array such that the magnetic array moves along the shaft when a particular force is applied. In response to receiving a trigger or activation signal from the processing device 140, the vibration system, which can be connected to a power source (e.g., through a base portion of the paver frame 120), can activate by passing a current through an electromagnetic coil, thereby generating a magnetic field. The direction of the current through the electromagnetic coil can determine the direction of the magnetic field and the motion of the magnetic array, thereby vibrating the paver.

In a more particular example, the vibration system 160 includes one or more linear actuators connected to the bottom surface of the paver, where each of the linear actuators include a magnet that is attached to a spring, which surrounds a coil. In response to providing a current through an electromagnetic coil, a mass moves back and forth within the coil, thereby providing the vibrational feedback.

Additionally or alternatively, the vibration system 160 can include a spring-loaded coil that is connected to a mass (e.g., a hammering mass). In response to receiving a trigger or activation signal from the processing device 140, the spring-loaded coil can cause the mass to contact the bottom surface 180 of the paver 110. For example, one or more spring-loaded coils can cause a corresponding mass, at a particular frequency or at a particular vibration intensity, to vertically strike the bottom surface 180 of the paver 110 to vibrate the paver 110. In another example, one or more spring-loaded coils can cause a corresponding mass, at a particular frequency or at a particular vibration intensity, to strike the paver frame 120 to apply a vibrational force to the paver frame 120, which, in turn, vibrates the paver 110 that is connected to the paver frame 120.

Although the embodiments described herein generally the vibration system as being positioned within the interior cavity 130 formed by connecting the paver 110 with the paver frame 120, this is merely illustrative. The vibration system can include a vibratory plate formed on the top surface 170 of the paver 110. In response to receiving a trigger or activation signal from the processing device 140, the vibration system, which can be connected to a power source (e.g., through a base portion of the paver frame 120), can generate a vibratory response signal to a person or an object positioned on the paver 110 by turning on the vibratory plate.

Although the embodiments described herein generally describe the paver frame as supporting the insertion of the paver (e.g., a precast concrete paver), this is merely illustrative. In some embodiments, the paver can be flexibly mounted to the paver frame using one or more springs (e.g., springs having a high stiffness). In such an embodiment, the vibration system can be configured to provide a vibrational force by providing a force to the springs used in flexibly mounting the paver to the paver frame.

It should be noted that, in some embodiments, the paver 110 and the paver frame 120 of the dynamic paver device can be composed of different materials. For example, the paver 110 can be a precast concrete paver in a hexagonal shape, while the paver frame 120 can be composed of a fiberglass material also in a hexagonal shape, where the paver frame 120 is formed to support the insertion of the precast concrete paver 110. In this example, in selecting a material for the paver frame, a lesser vibrational force can be generated by the vibration system 160 to vibrate the paver frame 120 composed of the fiberglass material than the vibrational force needed to vibrate the precast concrete paver 110. In another example, the paver 110 and the paver frame 120 can be composed of the same material (e.g., precast concrete) such that the vibrational force generated by the vibration system 160 is sufficient to vibrate the dynamic paver device at a level perceivable by a person standing on the dynamic paver device or a person using a mobility device (e.g., a wheelchair) situated on the top surface of the paver. In yet another example, the amount of force needed to vibrate the paver, the paver frame, or any other suitable component associated with the paver or the paver frame (e.g., one or more springs) can differ for different dynamic paver devices. In a more particular example, a particular amount of force that may be needed to vibrate a dynamic paver device incorporating a concrete paver can be different than the amount of force that may be needed to vibrate a dynamic paver device incorporating a rubber paver.

It should also be noted that the force generated by the vibration system and applied to the paver can be at sub-acoustic levels.

In some embodiments, the dynamic paver device can include any suitable processing device 140, such as a controller.

Processing device 140 can include any suitable hardware processor, such as a microprocessor, a micro-controller, digital signal processor(s), dedicated logic, and/or any other suitable circuitry for controlling the functioning of a general purpose computer or a special purpose computer in some embodiments. In some embodiments, processing device 140 can be controlled by a computer program stored in memory and/or storage of the dynamic paver device. For example, the computer program can cause the processing device 140 to detect presence of a person or an object on the surface of the dynamic paver device, transmit a signal to the vibration system to generate a force that vibrates the paver, and transmits a signal that causes the vibration system to stop generating the force that vibrates the paver, and/or perform any other suitable actions.

It should be noted that, in some embodiments, the processing device 140 can be used to control multiple dynamic paver devices. For example, the processing device 140 can transmit a signal to a vibration system that causes a force to be applied to multiple pavers. In another example, the processing device 140 can transmit a signal to multiple vibration systems that each cause a force to be applied to a corresponding paver.

Figure 5:
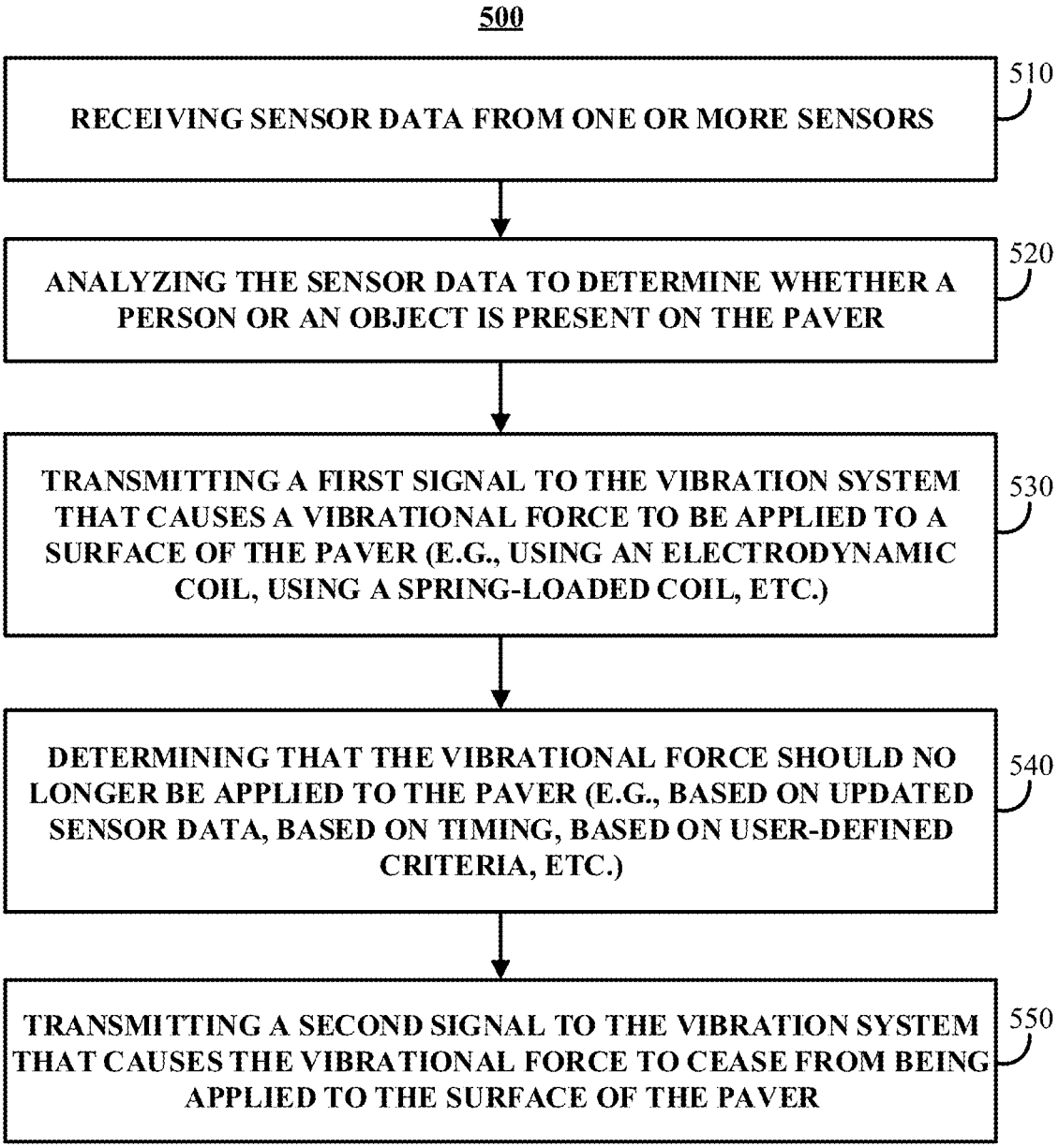
FIG. 5 shows an illustrative example of a process for generating a vibrational force by the dynamic paver device in accordance with some embodiments of the disclosed subject matter.

Turning to FIG. 5, an illustrative example of a process for generating a vibrational force by the dynamic paver device in accordance with some embodiments of the disclosed subject matter. In some embodiments, blocks of process 500 can be executed by processing device 140 of the dynamic paver device.

Process 500 can begin at 510 by receiving sensor data from the one or more sensors of the dynamic paver device. As described above, receiving the sensor data can include receiving a presence indicator that an object on the top surface of the paver is providing enough pressure such that the pressure sensor has detected that the change in the amount of pressure being applied to the top surface of the paver is greater than a threshold value. As also described above, this can include receiving a presence indicator that an object on the top surface of the paver is present based on image data from one or more optical sensors. In yet another example, this can include receiving sensor data from multiple sensors and receiving multiple presence indications from the multiple sensors.

In some embodiments, at 520, process 500 can continue by analyzing the sensor data to determine whether a person or an object is present on the paver. For example, in the implementation in which the sensor is a pressure sensor, the processing device can receive sensor data that indicates a detect change in the amount of pressure being applied to the top surface of the paver and, in response to receiving the sensor data, the processing device can determine whether the detected change in the amount of pressure is greater than a particular threshold amount indicating a likelihood that a person is standing on the surface of the paver. In another example, in the implementation in which the sensor is an optical sensor, the processing device can receive image data from the optical sensor and, in response to receiving the image data, the processing device can analyze the image data to determine the presence of an object, such as a person standing on the surface of the paver or a person using a wheelchair or other mobility device on the surface of the paver.

In response to determining the presence of an object on the paver, process 500 can transmit a first signal to the vibration system that causes the vibration system to generate a vibrational force to the bottom surface of the paver at 530.

As described above, in implementations in which the vibration system includes an electrodynamic coil, the processing device can cause a current to pass through the electrodynamic coil to generate a vibrational force beneath the paver.

As also described above, in implementations in which the vibration system includes a spring-loaded coil that is connected to a mass (e.g., a hammering mass), the processing device can cause a spring-loaded coil to release, which causes the connected mass to contact the bottom surface of the paver at a particular frequency, thereby generating a vibration force to the bottom surface of the paver.

It should be noted that, in some embodiments, the vibration system can generate a force that is applied to the paver and/or the paver frame. It should also be noted that, in some embodiments, the paver can be flexibly mounted to the paver frame using multiple springs, where the vibration system can generate a force that is applied to the springs, thereby causing the flexibly mounted paver to vibrate.

Additionally or alternatively to receiving sensor data and analyzing the sensor data to determine whether a person or an object is present on the paver, process 500 can receive an instruction to generate a vibrational feedback (e.g., from a traffic management system, from a building management system, or any other suitable source) and, in response, can transmit a signal that causes the vibration system to generate a vibrational force to the paver and/or the paver frame, thereby providing a vibrational feedback to a person or object positioned on or nearby the surface of the paver. For example, in response to determining a condition or event at a particular traffic intersection (e.g., the traffic light is red such that cars are not to proceed on a given roadway), the traffic management system can transmit an instruction to one or more dynamic paver devices to provide a vibrational feedback to a person or object positioned on or nearby the surface of the one or more pavers. This can, for example, provide an indication that the person can safely cross the intersection or provide an indication regarding the amount of time that the person can safely cross the intersection. This can also, for example, provide a warning that the condition or event at the particular traffic intersection is about to end or is about to change.

In some embodiments, at 540, process 500 can determine whether the vibrational force should continue to be applied.

For example, in some embodiments, process 500 can determine that a particular amount of time has elapsed from the time at which the vibrational force began being applied. In a more particular example, process 500 can determine that the vibrational force that causes the paver to vibrate should not be applied for more than ten seconds.

In another example, in some embodiments, process 500 can determine that the vibrational force should no longer be applied when the object on the surface of the paver is deemed to be stationary. In a more particular example, process 500 can begin providing the vibrational force that causes the paver to begin vibrating in response to detecting the beginning of occupancy (e.g., that an object has entered a region associated with the paver) and process 500 can determine, based on sensor data, that the object is stationary in about the same position on the surface of the paver. In another more particular example, process 500 can determine, based on sensor data from a radar sensor, that the object is stationary on the surface of the paver and that continued vibrational feedback is not necessary.

In some embodiments, at 550, process 500 can transmit a second signal to the vibration system that causes the vibrational force to the bottom surface of the paver. For example, process 500 can transmit a signal that deactivates the vibration system or otherwise inhibit the vibrational force from being applied to the paver. In another example, process 500 can transmit a signal that causes power to cease from being provided to the vibration system. In a more particular example, process 500 can receive updated sensor data that indicates the object is stationary on the paver (e.g., little to no change in pressure from the pressure sensor) and, in response, can inhibit the vibrational force from being applied to the paver.

Additionally or alternatively, in some embodiments, process 500 can determine that a greater vibration force is to be applied to the paver. For example, in response to determining that the object that is present on the surface of the paver continues to move based on the updated sensor data, process 500 can transmit a signal to the vibration system that causes a greater vibrational force to be applied to the bottom surface of the paver. In another example, instead of a greater vibrational force, process 500 can determine that the frequency of the vibration should be increased—e.g., from every 10 milliseconds to every 1 millisecond.

Figure 6:
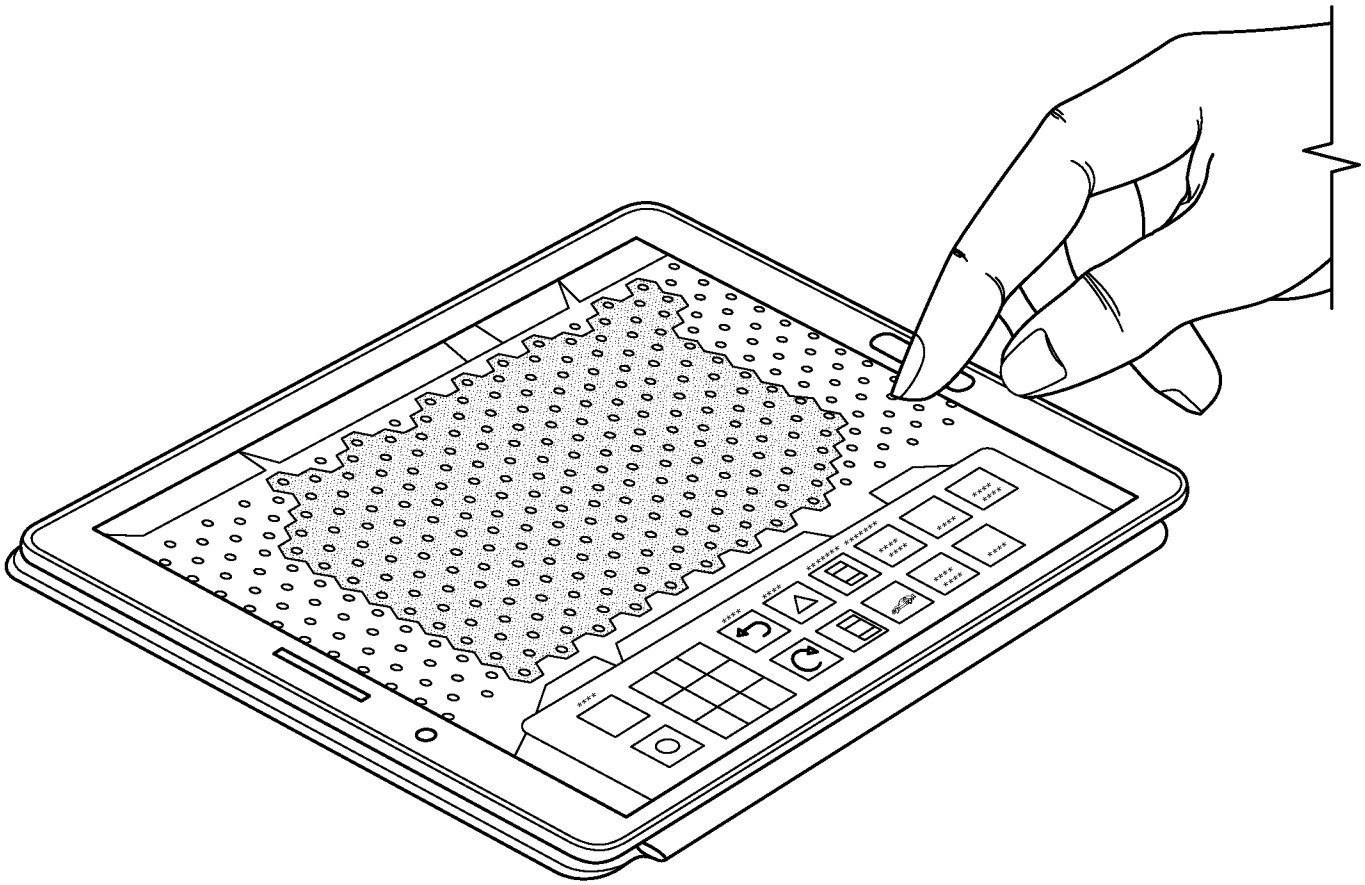
FIG. 6 shows an illustrative example of an application that can be used to operate one or more dynamic paver devices in accordance with some embodiments of the disclosed subject matter.

In some embodiments, the operation of one or more dynamic paver devices can be controlled via a user interface presented by a computing device (e.g., a tablet computer, a mobile phone, a monitor, and/or any other suitable user device) that is connected to the one or more dynamic paver devices. For example, FIG. 6 shows an illustrative example of a user interface for selecting one or more dynamic paver devices to activate in response to detecting presence or an occupant of a dynamic paver device. In a more particular example, a user of a building management system or a traffic management system can operate one or more dynamic paver devices via the user interface described above by selecting one or more dynamic paver devices to provide a vibration feedback in response to a detected event (e.g., a particular traffic signal event, etc.). In another example, the user interface can identify which pavers of a roadway or a walkway of interconnected pavers are dynamic paver devices capable of providing a vibratory feedback signal and the user interface can provide a user of the computer device with an opportunity to indicate which dynamic paver devices should be activated in response to particular events (e.g., a traffic condition). In yet another example, the user interface can allow the user of the computer device to provide vibration parameters, such as a maximum amount of time to provide the force that vibrates the paver (e.g., five seconds), a frequency for providing the force that vibrates the paver (e.g., every 4 milliseconds, every 10 milliseconds, etc.), a type of event that activates the vibration system of the dynamic paver device, etc. In a more particular example, a user of a traffic management system can provide vibration parameters for one or more dynamic paver devices (e.g., a high intensity vibration for an urgent warning versus a low intensity vibration to indicate that a person can cross an intersection).

In some embodiments, additionally or alternatively to activating the vibration system of a dynamic paver device based on sensor data, a user of a mobile device that is executing a mobile application can provide specific authorization to receive vibration feedback from dynamic paver device and specific authorization to provide location data. In response to using location data or other connectivity information (e.g., wireless network signals) associated with the mobile device, a system that controls multiple dynamic paver devices can determine that a user of the mobile device is occupying or beginning to occupy a particular dynamic paver device. In response to making the determination of the occupancy of the particular dynamic paver device, the system can trigger that particular dynamic paver device to activate the corresponding vibration system, which, in turn, generates a force that causes that particular dynamic paver device to begin vibrating. In another example, in response to being unable to associate the position of the mobile device with a particular dynamic paver device, the system can inhibit the vibration of one or more dynamic paver devices.

It should be noted that, prior to detecting location information associated with a mobile device for activating a dynamic paver device, these mechanisms can provide the user associated with the mobile device with an opportunity to provide a consent or authorization to perform such detections. For example, upon loading an application on a mobile device (e.g., an application relating to providing vibration feedback from one or more dynamic paver devices), the application can prompt the user to provide authorization for performing such detections and/or transmitting information relating to the detections. In a more particular example, in response to downloading the application and loading the application on the mobile device, the user can be prompted with a message that requests (or requires) that the user provide consent prior to performing these detections. Additionally or alternatively, in response to installing the application, the user can be prompted with a permission message that requests (or requires) that the user provide consent prior to performing these detections and/or transmitting information relating to these detections.

It should be noted that the dynamic paver device can be used in any suitable applications. For example, multiple dynamic paver devices can be placed along the periphery of a roadway such that vibrational feedback signals can be provided to a person standing on the periphery of the roadway (e.g., to notify the person that the traffic signal is about to change, to notify the person that the person does not have the right of way, to notify the person of an active roadway or an oncoming vehicle, to notify the person to proceed with caution, etc.). In another example, multiple dynamic paver devices can be positioned within a pathway such that vibrational feedback signals can be provided at particular portions of the pathway (e.g., to notify the person of a transition in regions, such as the transition of a pedestrian walkway to a walkway that is shared with bicycle traffic). In yet another example, multiple dynamic paver devices can be positioned along a crosswalk, where the vibrational feedback signals can be provided to indicate that a user is currently on the crosswalk (e.g., as opposed to off the crosswalk and entering the roadway) and where the frequency or intensity of the vibrational feedback signals can indicate an amount of time remaining to cross an intersection (e.g., greater frequency signals corresponding to a time remaining until a traffic signal changes).

Figure 7:
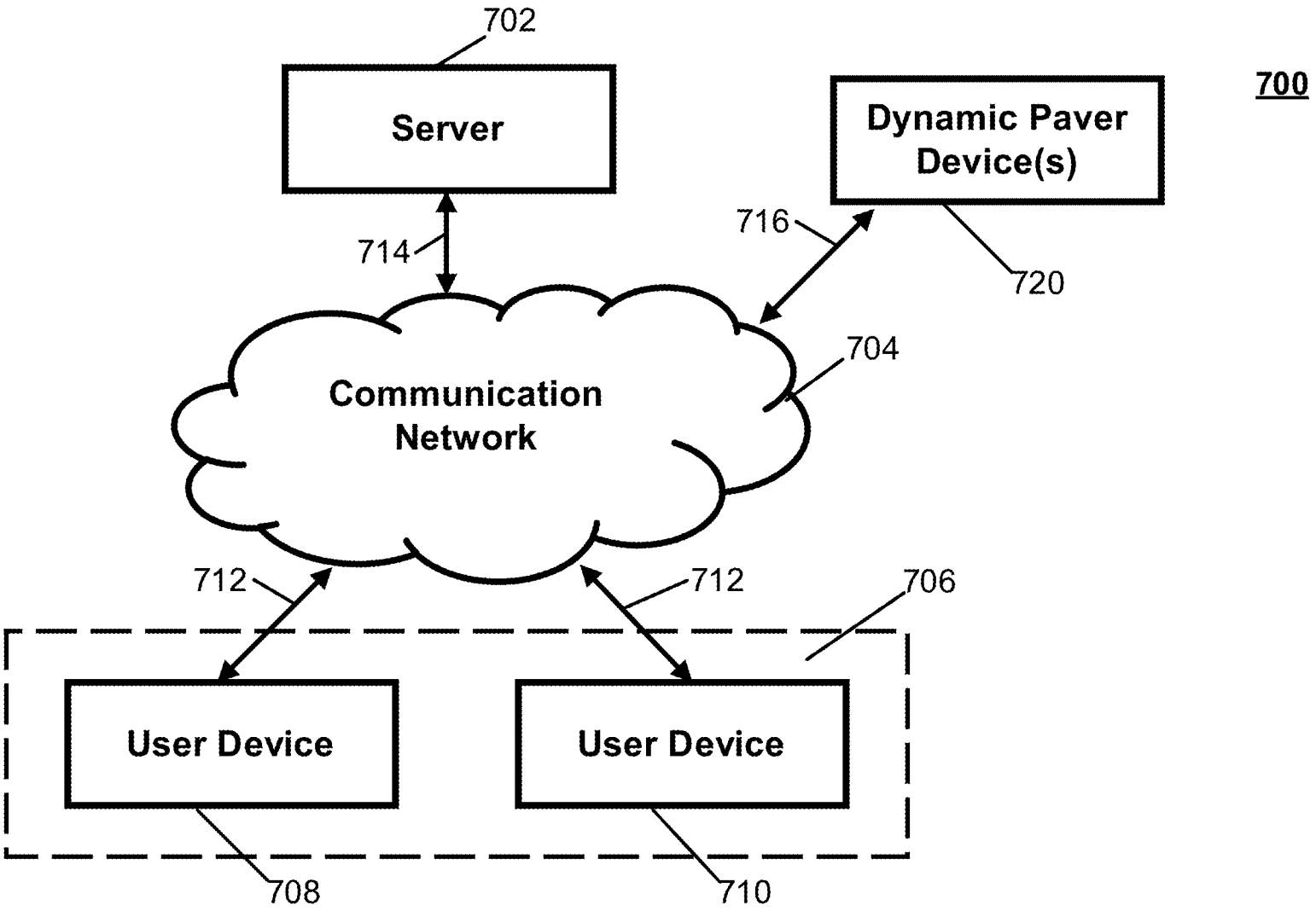
FIG. 7 shows a schematic diagram of an illustrative system suitable for implementation of mechanisms described herein for controlling one or more dynamic paver devices in accordance with some embodiments of the disclosed subject matter.

Turning to FIG. 7, an illustrative example 700 of hardware for controlling one or more dynamic paver devices in accordance with some embodiments of the disclosed subject matter is shown. As illustrated, hardware 700 can include a server 702, a communication network 704, one or more user devices 706, such as user devices 708 and 710, and/or one or more dynamic paver devices 720 (e.g., such as dynamic paver device 100 shown in FIG. 1).

Server 702 can be any suitable server(s) for storing information, data, programs, and/or any other suitable type of content. In some embodiments, server 702 can perform any suitable function(s). For example, in some embodiments, server 702 can be used to receive authorization instruction to receive a vibrational feedback signal from dynamic paver device 720 (or dynamic paver device in a particular location when compared with location information of the user device) and can instruct a particular dynamic paver device 720 to provide vibrational feedback signals having particular characteristics (e.g., a particular frequency, a particular strength, etc.) given particular traffic characteristics (e.g., crossing a busy intersection). In another example, in some embodiments, server 702 can be used to receive presence information from external imaging devices (e.g., an imaging device associated with a traffic management system) and can instruct a particular dynamic paver device 720 to provide vibrational feedback signals based on the presence information (e.g., in response to detecting that a person or a mobility device is present on the dynamic paver device 720). Additionally or alternatively, in some embodiments, server 702 can be used to receive presence information from external imaging devices (e.g., an imaging device associated with a traffic management system) and can instruct a particular dynamic paver device 720 to provide vibrational feedback signals based on the detection of particular traffic characteristics (e.g., a warning to avoid a potential accident, a warning regarding a vehicle travelling at a particular speed, an indication that it is safe to cross the intersection, etc.). In yet another example, server 702 can be used to receive sensor data from one or more sensors associated with the dynamic paver device 720 and can determine whether a person or a mobility device is present on the dynamic paver device 720. In a further example, server 702 can be used to receive sensor data from one or more sensors associated with the dynamic paver device 720 and can determine whether a vibrational feedback signal should be generated based on the sensor data, such as pressure data, meeting a particular threshold value (e.g., an average pressure that a mobility device exerts).

Communication network 704 can be any suitable combination of one or more wired and/or wireless networks in some embodiments. For example, communication network 704 can include any one or more of the Internet, an intranet, a wide-area network (WAN), a local-area network (LAN), a wireless network, a digital subscriber line (DSL) network, a frame relay network, an asynchronous transfer mode (ATM) network, a virtual private network (VPN), and/or any other suitable communication network. User devices 706 can be connected by one or more communications links (e.g., communications links 712) to communication network 704 that can be linked via one or more communications links (e.g., communications links 714) to server 702. Dynamic paver devices 720 can be connected by one or more communications links (e.g., communications links 716) to communication network 704 that can be linked via one or more communications links (e.g., communications links 714) to server 702. The communications links can be any communications links suitable for communicating data among user devices 706, server 702, and dynamic paver devices 720, such as network links, dial-up links, wireless links, hardwired links, any other suitable communications links, or any suitable combination of such links.

User devices 706 can include any one or more user devices suitable for transmitting instructions to a server to control vibrational feedback signals from one or more dynamic paver devices. For example, in some embodiments, user devices 706 can provide a user interface, such as the user interface shown in FIG. 6, to select one or more dynamic paver devices within a particular location to receive vibrational feedback signals. In another example, in some embodiments, user devices 706 can transmit preferences to server 702 to perform any of the functions described above, such as receiving vibrational feedback signals, altering strength or frequency of the vibrational feedback signals, provide characteristics relating to the user or the mobility device (e.g., a type of a mobility device being used), provide general authorization to receiving warning signals via vibrational feedback signals. In some embodiments, user devices 706 can include any suitable types of devices. For example, in some embodiments, user devices 706 can include a desktop computer, a laptop computer, a mobile phone, a tablet computer, and/or any other suitable type of user device.

Although server 702 is illustrated as one device, the functions performed by server 702 can be performed using any suitable number of devices in some embodiments. For example, in some embodiments, multiple devices can be used to implement the functions performed by server 702.

Although two user devices 708 and 710 are shown in FIG. 7 to avoid over-complicating the figure, any suitable number of user devices, and/or any suitable types of user devices, can be used in some embodiments.

Figure 8:
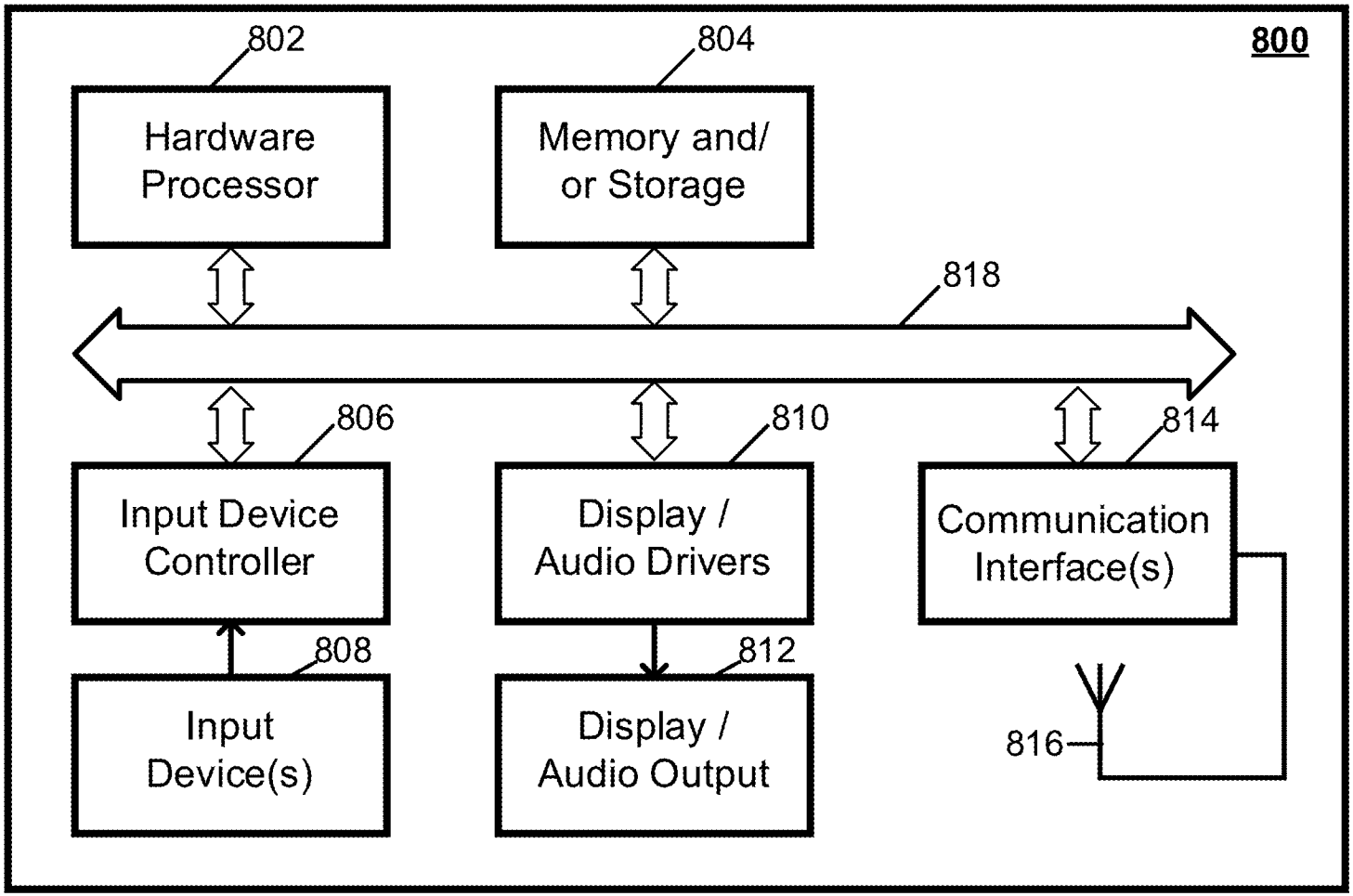
FIG. 8 shows a detailed example of hardware that can be used in a server and/or a user device of FIG. 7 in accordance with some embodiments of the disclosed subject matter.

Server 702 and user devices 706 can be implemented using any suitable hardware in some embodiments. For example, in some embodiments, devices 702 and 706 can be implemented using any suitable general-purpose computer or special-purpose computer. For example, a mobile phone may be implemented using a special-purpose computer. Any such general-purpose computer or special-purpose computer can include any suitable hardware. For example, as illustrated in example hardware 800 of FIG. 8, such hardware can include hardware processor 802, memory and/or storage 804, an input device controller 806, an input device 808, display/audio drivers 810, display and audio output circuitry 812, communication interface(s) 814, an antenna 816, and a bus 818.

Hardware processor 802 can include any suitable hardware processor, such as a microprocessor, a micro-controller, digital signal processor(s), dedicated logic, and/or any other suitable circuitry for controlling the functioning of a general-purpose computer or a special-purpose computer in some embodiments. In some embodiments, hardware processor 802 can be controlled by a server program stored in memory and/or storage of a server, such as server 702. In some embodiments, hardware processor 802 can be controlled by a computer program stored in memory and/or storage 804 of user device 706.

Memory and/or storage 804 can be any suitable memory and/or storage for storing programs, data, and/or any other suitable information in some embodiments. For example, memory and/or storage 804 can include random access memory, read-only memory, flash memory, hard disk storage, optical media, and/or any other suitable memory.

Input device controller 806 can be any suitable circuitry for controlling and receiving input from one or more input devices 808 in some embodiments. For example, input device controller 806 can be circuitry for receiving input from a touchscreen, from a keyboard, from one or more buttons, from a voice recognition circuit, from a microphone, from a camera, from an optical sensor, from an accelerometer, from a temperature sensor, from a near field sensor, from a pressure sensor, from an encoder, and/or any other type of input device.

Display/audio drivers 810 can be any suitable circuitry for controlling and driving output to one or more display/audio output devices 812 in some embodiments. For example, display/audio drivers 810 can be circuitry for driving a touchscreen, a flat-panel display, a cathode ray tube display, a projector, a speaker or speakers, and/or any other suitable display and/or presentation devices.

Communication interface(s) 814 can be any suitable circuitry for interfacing with one or more communication networks (e.g., computer network 704). For example, interface(s) 814 can include network interface card circuitry, wireless communication circuitry, and/or any other suitable type of communication network circuitry.

Antenna 816 can be any suitable one or more antennas for wirelessly communicating with a communication network (e.g., communication network 704) in some embodiments. In some embodiments, antenna 816 can be omitted.

Bus 818 can be any suitable mechanism for communicating between two or more components 802, 804, 806, 810, and 814 in some embodiments.

Any other suitable components can be included in hardware 800 in accordance with some embodiments.

In some embodiments, at least some of the above described blocks of the process of FIG. 5 can be executed or performed in any order or sequence not limited to the order and sequence shown in and described in connection with the figures. Also, some of the above blocks of FIG. 5 can be executed or performed substantially simultaneously where appropriate or in parallel to reduce latency and processing times. Additionally or alternatively, some of the above described blocks of the process of FIG. 5 can be omitted.

In some embodiments, any suitable computer readable media can be used for storing instructions for performing the functions and/or processes herein. For example, in some embodiments, computer readable media can be transitory or non-transitory. For example, non-transitory computer readable media can include media such as magnetic media (such as hard disks, floppy disks, and/or any other suitable magnetic media), optical media (such as compact discs, digital video discs, Blu-ray discs, and/or any other suitable optical media), semiconductor media (such as flash memory, electrically programmable read-only memory (EPROM), electrically erasable programmable read-only memory (EEPROM), and/or any other suitable semiconductor media), any suitable media that is not fleeting or devoid of any semblance of permanence during transmission, and/or any suitable tangible media. As another example, transitory computer readable media can include signals on networks, in wires, conductors, optical fibers, circuits, any suitable media that is fleeting and devoid of any semblance of permanence during transmission, and/or any suitable intangible media.

Accordingly, a dynamic paver device with vibration feedback is provided.

Although the invention has been described and illustrated in the foregoing illustrative embodiments, it is understood that the present disclosure has been made only by way of example, and that numerous changes in the details of implementation of the invention can be made without departing from the spirit and scope of the invention, which is limited only by the claims that follow. Features of the disclosed embodiments can be combined and rearranged in various ways.

What is claimed is:

1. A paver device comprising:

a paver having a top surface and a bottom surface;

a paver frame that is flexibly mounted to the paver and that creates an interior cavity upon being connected with the paver;

at least one pressure sensor connected to the paver, wherein the at least one pressure sensor detects a change in an amount of pressure applied to the top surface of the paver;

a vibration system connected to the bottom surface of the paver, wherein the vibration system is configured to provide a vibrational force to one or more portions of the paver frame or the bottom surface of the paver; and a controller connected to the at least one pressure sensor and the vibration system, wherein the controller is configured to:

receive, from the at least one pressure sensor, a presence indication of an object on the top surface of the paver based on the detected change in the amount of pressure being applied to the top surface of the paver at a first time; and in response to receiving the presence indication from the at least one pressure sensor, transmit a first signal to the vibration system that causes the vibration system to provide the vibrational force to one or more portions of the paver frame or the bottom surface of the paver.

2. The paver device of claim 1, wherein the paver is a precast concrete slab formed in a hexagonal shape.

3. The paver device of claim 1, wherein the paver is a rubber paver formed in a hexagonal shape.

4. The paver device of claim 1, wherein the paver is a porous paver formed in a hexagonal shape.

5. The paver device of claim 1, wherein the paver and the paver frame each have a hexagonal shape and form a hexagonal prism having the interior cavity when the paver and the paver frame are connected.

6. The paver device of claim 1, wherein the paver is flexibly mounted to the paver frame using one or more springs, and wherein the vibration system is configured to provide the vibrational force to the one or more springs.

7. The paver device of claim 1, wherein the paver is constructed from a first material and the paver frame is constructed from a second material, and wherein the first material is different than the second material.

8. The paver device of claim 1, wherein the at least one pressure sensor is positioned within the interior cavity.

9. The paver device of claim 1, wherein the at least one pressure sensor is connected to the bottom surface of the paver.

10. The paver device of claim 1, wherein the presence indication is received from the at least one pressure sensor in response to determining that the change in the amount of pressure is greater than a threshold amount.

11. The paver device of claim 1, wherein the vibration system includes an electrodynamic coil that generates the vibrational force to the bottom surface of the paver, and wherein the electrodynamic coil is connected to a power source.

12. The paver device of claim 1, wherein the vibration system includes a spring-loaded coil that is connected to a mass, and wherein the mass contacts the bottom surface of the paver via the spring-loaded coil.

13. The paver device of claim 1, wherein the controller is further configured to:

determine that a particular amount of time has elapsed; and in response to the determining that the particular amount of time has elapsed, transmit a second signal to the vibration system that causes the vibration system to inhibit the vibrational force from continuing to be applied to the bottom surface of the paver.

14. The paver device of claim 1, wherein the controller is further configured to receive an instruction to provide the vibrational force to the bottom surface of the paver.

15. The paver device of claim 1, wherein the controller is connected to an additional paver that is adjacent to the paver, and wherein the controller is further configured to transmit instructions to provide the vibrational force to the paver and the additional paver.

16. The paver device of claim 1, wherein the controller is connected to a power source.

17. The paver device of claim 1, wherein the controller is further configured to transmit a second signal to the vibration system that causes the vibration system to inhibit the vibrational force from continuing to be applied to the bottom surface of the paver based on an updated change in the amount of pressure being applied to the top surface of the paver at a second time.

18. The paver device of claim 17, wherein the updated change in the amount of pressure indicates that the object is stationary on the top surface of the paver, and wherein the second signal is transmitted to the vibration system that causes the vibration system to provide a different vibrational force to the bottom surface of the paver.

19. The paver device of claim 17, wherein the updated change in the amount of pressure indicates that the object is continuing to move, and wherein the second signal is transmitted to the vibration system that causes the vibration system to provide a different vibrational force to the bottom surface of the paver.

20. A paver device comprising:

a paver having a top surface and a bottom surface;

a paver frame that creates an interior cavity upon being connected with the paver;

an optical sensor that detects presence of an object on the top surface of the paver, wherein the optical sensor is configured to receive image data relating to one or more objects on the top surface of the paver;

a vibration system connected to the bottom surface of the paver, wherein the vibration system is configured to provide a vibrational force to the bottom surface of the paver; and a controller connected to the optical sensor and the vibration system, wherein the controller is configured to:

receive, from the optical sensor, a presence indication of the object on the top surface of the paver based on the received image data relating to the one or more objects on the top surface of the paver; and in response to receiving the presence indication from the optical sensor, transmit a first signal to the vibration system that causes the vibration system to provide the vibrational force to the bottom surface of the paver.

* * * * *